United States Patent [19]

Schmidt

[11] Patent Number: 4,829,710

[45] Date of Patent: May 16, 1989

[54] DISENGAGING DEVICE

[75] Inventor: Karl H. Schmidt, Wilnsdorf-Niederdielfen, Fed. Rep. of Germany

[73] Assignee: Siegenia-Frank KG, Siegen, Fed. Rep. of Germany

[21] Appl. No.: 134,841

[22] Filed: Dec. 18, 1987

[30] Foreign Application Priority Data

Dec. 22, 1986 [DE] Fed. Rep. of Germany ..... 3643965

[51] Int. Cl.[4] ..... E05D 15/26

[52] U.S. Cl. ..... 49/125

[58] Field of Search ..... 49/125, 127, 130, 129, 49/128, 221, 223

[56] References Cited

U.S. PATENT DOCUMENTS

| | | | |
|---|---|---|---|
| 2,741,807 | 4/1956 | Powers . | |
| 4,384,429 | 5/1983 | Rokicki et al. | 49/130 |
| 4,551,945 | 11/1985 | von Resch | 49/221 |
| 4,644,690 | 2/1987 | Caimi | 49/130 |
| 4,669,219 | 6/1987 | Tomida | 49/130 |

FOREIGN PATENT DOCUMENTS

| | | |
|---|---|---|
| 1075007 | 2/1982 | Fed. Rep. of Germany . |
| 1774702 | 1/1983 | Fed. Rep. of Germany . |
| 3234677 | 3/1984 | Fed. Rep. of Germany . |
| 8435367 | 2/1985 | Fed. Rep. of Germany . |
| 1813918 | 6/1987 | Fed. Rep. of Germany . |
| 1551381 | 11/1968 | France . |

*Primary Examiner*—Philip C. Kannan
*Attorney, Agent, or Firm*—Blodgett & Blodgett

[57] ABSTRACT

A disengaging device which is constructionally simple and operationally reliable for a wing of a window, door or the like which is required to take up a configuration parallel and disengaged from a stationary frame in order to be slidable horizontally for opening and closing. The wing is connected to the frame with upper and lower swingout arms in pairs. The lower swingout arms are each pivotally mounted at the lower transverse wing bar at one end and to a traveling carriage at the other end. A releasable blocking device is provided for the lower swing out arms which is activated when they are in the disengaged and stable parallel position. The blocking device is activated through a control arm associated with the lower traveling carriages. The control arm can be brought into and out of operative connection with a thrust bearing located on the stationary frame. The control arm is mounted on the traveling carriage and limited to basically horizontal planar motion in a limitedly swivelable manner. It is configured as a two armed lever. At the free end of the first lever arm, which runs and extends in the direction in which the wing is closed, a locking link is provided. At the free end of the other lever arm, a connection lashing is articulated. An additional arm is pivoted to the swingout arm at one end and at the other end engages by means of a pinion in a swivelable and movable manner in a guide slot formed in a bearing surface in the wing. At the end of the guide slot, an uptake notch is provided which accepts the pinion of the additional arm when the device is in the parallel stop position. This connection lashing is connected in a swivelable manner to the additional arm, the connection being made between its joint with the swingout arm and the pinion end, thereby coupling its motion with that of the control arm 23.

10 Claims, 5 Drawing Sheets

DISENGAGING DEVICE

BACKGROUND OF THE INVENTION

This invention relates to a mechanism for disengaging the wing of a window, a door or the like, a wing of which is pulled out and blocked into a stable position parallel to a stationary frame for the purpose of being slid horizontally and sideways. This disengagement is provided in part by upper and lower swing out arms, each of which is pivotally mounted at one end to the lower transverse bar of the wing and at the other end to a traveling carriage on the stationary frame. A mechanism for releasably blocking at least one of the swing out arms in the position where the wing is located in its stable position parallel to the frame comprises a control arm operatively connected to the swing out arm in the region of the traveling carriage. This control arm can be brought into and out of operative connection by means of a control lug associated with a thrust bearing located on the stationary frame near the limit of the motion of the wing when it is slid closed. This control arm is supported on the traveling carriage in a horizontal plane, and its movement is limited to swiveling in that plane. The control arm functions as a two-armed lever, one of the arms being free and carrying a locking link which extends in the same direction as the wing when the wing is slid closed.

A mechanism of this kind is shown in DE-GM No. 84 35 367.

This control arm, which is able to swivel in a very limited manner and is mounted on the traveling carriage, acts through a second lever arm directed away at an obtuse angle from that lever arm which is carrying the locking link. The arm acts as a supporting link, along with the adjacent swing out arm, when the mechanism is blocked into the parallel stable position. By this assemblage, the forces which act in a closing sense on the wing when it is in the stable parallel position are positively but unsymmetrically introduced onto the traveling carriage and supported by the guiding runners. This support is through the pivot bearing of the swing out arm as well as through the swivel bearing of the control arm which is spaced from it.

Such a swing out arm, however, is freely pivotally mounted at the lower transverse bar of the wing and therefore the action of forces transmitted to the traveling carriage are introduced unsymetrically to its runners and into the stationary guide rail of the frame side. The result can be not only undesirable deformations of the guide rail but also it is possible that the runners of the traveling carriages may run up at the rounded off profile of the guide web of the guide rail and thus get out of guide engagement with it.

The same difficulties are also seen in a mechanism as shown in DE-OS No. 32 34 677. There, an additional arm is connected in a swivelable manner to the swingout arm at one end and engages at the other end by means of a pinion in a guide slot on the traveling carriage. This guide slot is provided with a stop uptake for the pinion of the additional arm when the wing is in the parallel stable position.

In this case the stop uptake for the pinion of the additional arm is spaced a considerable distance from the pivot bearing of the swing out arm which is also on the traveling carriage. Since the guide slot is situated in a spiked continuation of the traveling carriage which projects in the direction of wing when it is slid closed, the deficiencies of the mechanism shown in DE-GM No. 84 35 367 appear here in a still higher degree.

These deficiencies are not apparent in the mechanism shown in U.S. Pat. No. 2,741,807 because in that case, the control arm which acts as a supporting lever is able to introduce the action of forces exerted upon the parallel stopped wing transverse to its plane. This is because it is pivotally mounted in alignment with the swing out arm directly into the stationary frame, thereby bypassing the travelling carriage. This is only possible however, when the control arm consistently interacts over the whole length of the horizontal slide path of the wing with a rail-like thrust bearing which is mounted on the frame or otherwise stationarily mounted. By this means, the parallel stop position of the swingout arms can be maintained by the control arm throughout any possible sliding position.

In the fitting according to the French patent No. 1,551,381, the control arm which is pivoted at the traveling carriage and acts as a supporting lever, interacts constantly with the guide rail which carries the traveling carriage until the wing has slid to the end position of its closed configuration. It is only at this point that the control lug and the control arm with the swingout arm are freed. Subsequently, the wing can be moved, by means of the swing out arms, into its closed position at the stationary frame.

It is a characteristic disadvantage of all the above discussed known mechanisms that the pivotal connection of the swingout arm in its interaction with the releasable blocking device continues to be maintained when it is in its parallel stable position. Because of this, angular displacements of the swingout arm relative to the wing when in the parallel stable position cannot be effectively eliminated.

It is therefore, a primary object of the present invention to provide a disengaging device of the above mentioned type in which the swingout arm, interacting with the blocking device, is positively braced or blocked against the wing when in its swivel position corresponding to the parallel stable position; while at the same time, the functioning of the releasable blocking device and the interaction of its control lug with the thrust bearing situated at the stationary frame is not impaired during the end movement of the wing as it is slid closed.

Other objects of the invention will become apparent as the details of an embodiment are disclosed.

SUMMARY OF THE INVENTION

The object of the invention is achieved generally by the provision of an additional arm connected in a swiveling manner to the swing out arm at one end and which engages a guide slot in the wing by means of a pinion which is also swivelable and slidable. This guide slot is provided with an uptake notch at the end of the guide slot which corresponds to the stable parallel position of the wing. The two armed control arm has a connection lashing articulated at its second free end which connects that second free end to the additional arm in a pivotal manner, the connection being made at the area of the additional arm between its pinion and its joint or connection at the swing out arm. The combination of this lashing and the control arm form an enforced movement coupling.

It is a benefit of this construction of a disengagement device that the combination of the swingout arm, the second lever arm of the control arm, the connection lashing, and the additional arm form a hinge-quadrilateral. Because of this, the fixing motion of the control arm of the blocking device and of the additional arm of the disengaging device are brought into interdependence. Thus, the additional arm engages in the blocking uptake notch just as the swingout arm comes out of engagement with the thrust bearing of the frame side. Conversely, the additional arm disengages from the blocking uptake notch of the wing after the control arm comes into engagement with the thrust bearing of the frame side. Because of this enforced coupling, the parallel shifting of the wing relative to the stationary frame can only be begun after the wing has been brought completely into its parallel stable position. Furthermore, the wing can only leave its parallel stable position after it has been pushed back into the position relative to the stationary frame which is necessary for its correct closing.

It is thus characteristic of the invention that the swingout arms are held in their parallel stable position throughout the movement of the wing in the sliding and closing direction until the control lug on the control arm which faces in the direction of the slide closing motion of the wing comes into operative connection with the thrust bearing on the stationary frame. At this point, a return coupling movement comes about in a well-controlled manner acting on the additional arm which is locking the wing. Until then, the forces acting on the wing in the "slide closed" direction provide a stress on the uptake notch associated with the additional arm. This stress is in a blocking sense or in the sense of positively locking the swingout arm against the wing.

A further aspect of the invention provides that the control arm is journaled on the traveling carriage approximately in alignment with the articulation site of the swing out arm. It is thus a further aspect of the invention that the two lever arms of the control arm may be arranged at an obtuse angle to each other so that the joint between the second lever arm and the connection lashing lies on the same plane as the joint of the swingout arm on the wing when the wing is in closed position and this plane is approximately parallel to the stationary frame.

A further aspect of the invention involves the thrust bearing or stationary stop on the stationary frame which has an arcuate shape or a shape of a "curved claw" and whose outlet/inlet opening lies closer to the plane of the stationary frame than does its closed end section.

A further aspect of the invention involves improving the operational reliability of the disegaging device of the invention by the provision of an initial stressing force, in the form of a spring for example, acting on the control arm in the blocking sense. A further aspect of the invention resides in the fact that the stop uptake notch runs at an angle relative the guide slot and that its angle of inclination has a curvature which has at least approximately a covering position. The center of curvature of the notch coincides with the joint between the additional arm and the swingout arm when both are located in the parallel stable position relative to the wing. It is preferred that the stop uptake notch be provided with its end facing away from the stationary frame.

In another aspect of the invention a particular disengaging device has two swingout arms each provided with an additional arm. The operational reliability of the device is improved by provision of a coupling which makes them move in unison; for example, by means of a thrust rod.

A particularly advantageous alternative embodiment of the disengaging device of the present invention comprises two traveling carriages provided with their respective swingout arms, their respective additional arms and the associated wing side bearing blocks configured in a mirror image manner towards each other, the swing arms rotating in an opposite sense to each other and their movements coupled together via a differential gear coupling which is guided through the ends of the additional arms at the wing in a swivelable and movable manner.

Using this alternative construction, the disengaging device can be used without change of design both for right and for left horizontally slidable wings of windows and doors, from the closing position into the opening position. In this case, the disengaging devices interact with the wing in the manner of a so-called trapezoid guide system which has the advantage of facilitating an exact parallel shifting of the wing transverse to its plane. In this embodiment, the differential gear coupling is preferably provided in the form of two thrust rods kept in constant driving connection with each other via a reversing gear.

BRIEF DESCRIPTION OF THE DRAWINGS

The invention may be best understood by reference to one of its structural forms as shown in the accompanying drawings in which.

DETAILED DESCRIPTION OF THE PREFERRED EMBODIMENT

FIGS. 1–6 of the drawings present a balcony or terrace door which is provided with a stationary frame 1, a fixedly mounted wing 2 (or a solid door panel 2) and is additionally provided with a movable wing 3.

Figure 1:
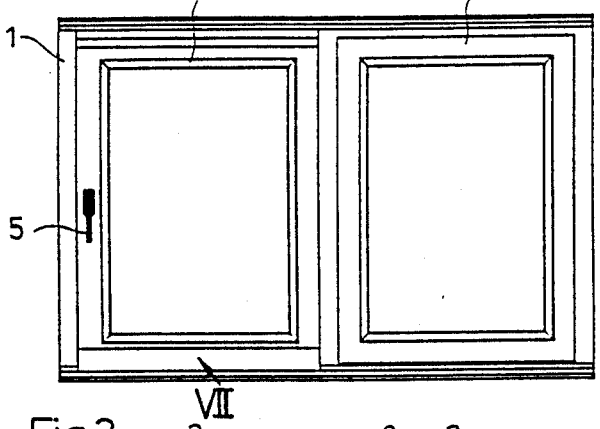
FIG. 1 and FIG. 2 show, in front and side elevation respectively, a parallel-stoppable, tilt-slide door with the wing closed position.
Figure 2:
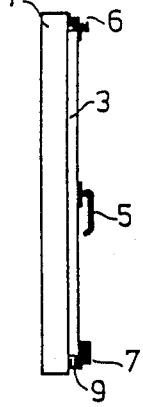
Figure 3:
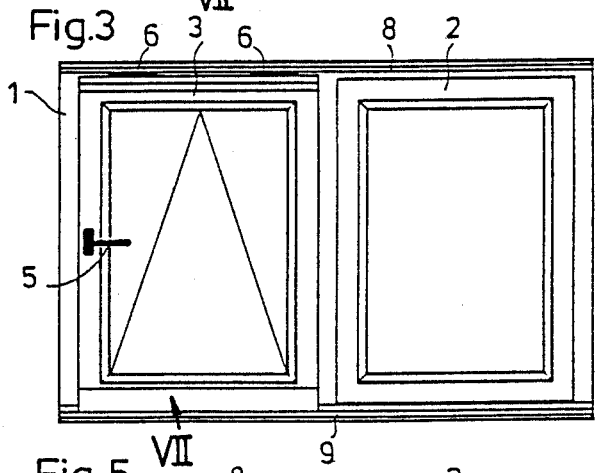
FIGS. 3 and 4 show, in front and side elevation respectively, the parallel-stoppable, tilt-slide door with the wing open in the tilt position, FIGS. and 6 show in front side elevation respectively, the parallel-stoppable, tilt-slide door with the wing stabilized in parallel position and horizontally shifted into open position.
Figure 4:
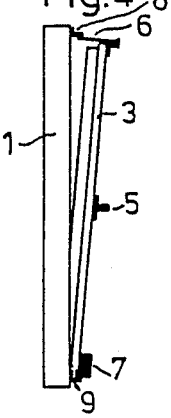
Figure 5:
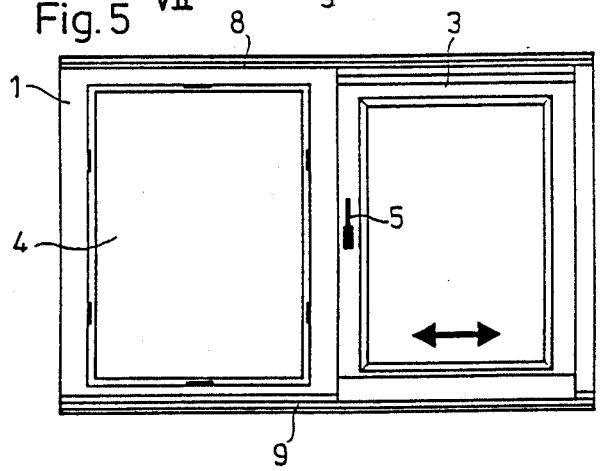
Figure 6:
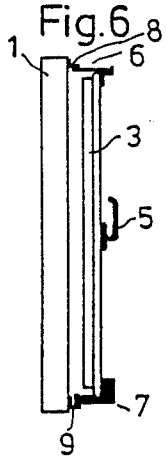

This movable wing 3 can be brought from a closed position indicated in FIGS. 1 and 2 into the tilt-open position as seen in FIGS. 3 and 4 relative to the stationary frame 1 and to the fixedly mounted wing or door panel 2. However, the wing can also be brought into a parallel stable position relative to the stationary frame 1 and the fixedly mounted wing or solid door panel 2 and then can be shifted from the area of the passage opening 4 of the stationary frame 1 in a horizontal direction until it is in front of the fixedly installed wing or the solid door panel 2 as can be seen in FIGS. 5 and 6.

To permit these three positions of the wing 3 relative to the stationary frame 1 and to the fixedly mounted wing or solid door panel 2 a special fitting arrangement is provided between the wing and the stationary frame which might be termed a tilt/parallel, stable-sliding fitting. Only those parts of the fitting which are necessary for understanding of the invention are shown in FIGS. 1 through 6. These parts are the manual handle 5 on the wing 3 and the upper disengaging device 6 as well as the lower disengaging device 7 disposed between the wing 3 and the stationary frame 1.

For the sake of the movements described here, the upper disengaging device 6 and the lower disengaging device 7 may be similarly configured. However, the basic construction of the upper disengaging device 6 may also be based on such constructions as are in use for windows or doors with a tilt-or rotary wing and which are shown to be known in the art by DE-GM No. 17 74 702, DE-GM No. 18 13 918, and DE-AS No. 10 75 007. It is only necessary to assure that the frame side articulation sites of the disengaging device sites of these disengaging devices constantly engage in a horizontal sliding guide 8 at the upper transverse bar of the stationary frame 1 and that a synchronous motion of the swingout arm is ensured.

The lower disengaging device 7 must be consistently configured so that it can reliably carry the weight of the movable wing while the device interacts with a guide rail 9 on the lower transverse bar of the stationary frame.

Figure 7:
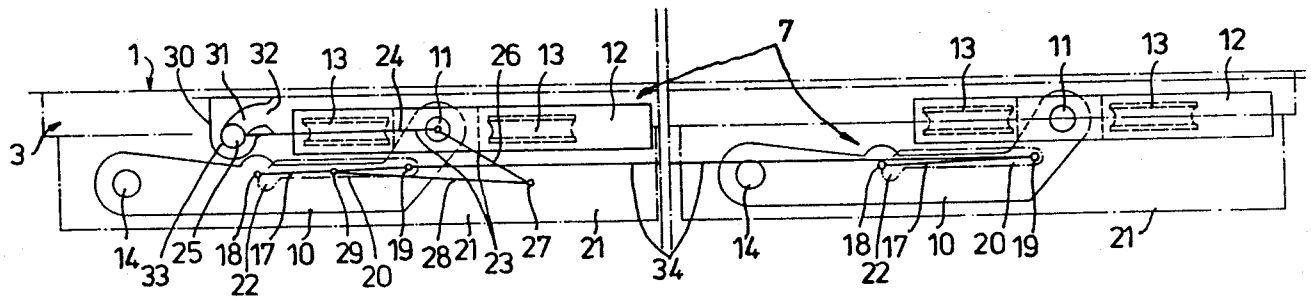
FIG. 7 shows the mechanism in the configuration of FIGS. 1 and 3 in the region marked VII; the mechanism is shown in top view and in its operative position corresponding to FIGS. 2 and 4.
Figure 8:
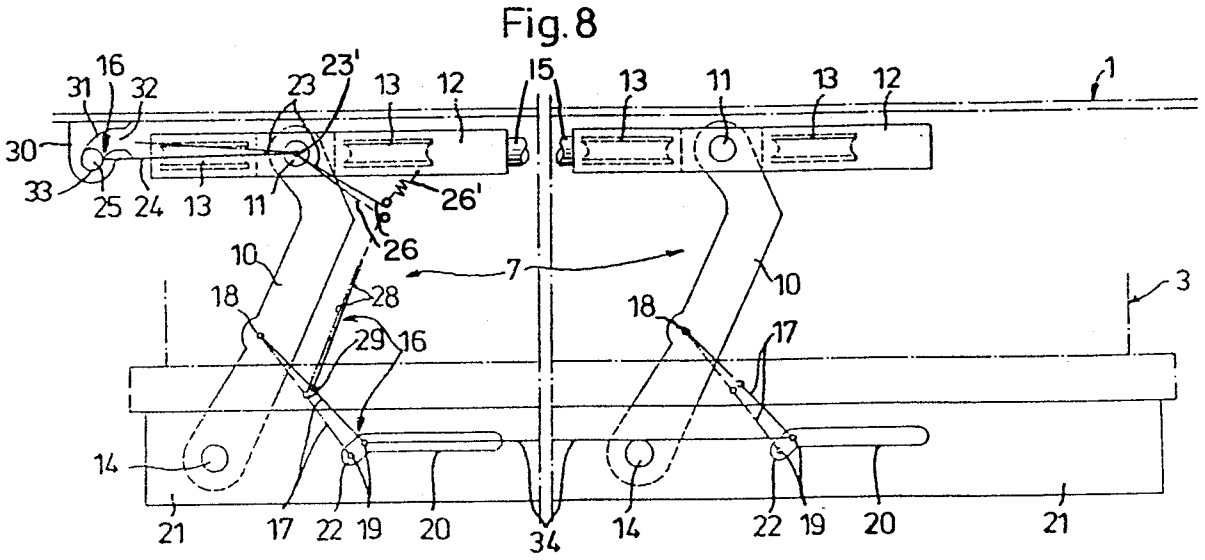
FIG. 8 shows the mechanism as in FIG. 7 but in its operative position corresponding to FIG. 6 and FIGS. 9 and 10 illustrate a modified embodiment of the disengaging device in the operative positions corresponding to FIGS. 7 and 8 respectively.

The novel aspects of the present case are best seen in the view of the construction and mode of operation of the lower disengaging device 7 in FIGS. 7 and 8 which is a top view and is somewhat schematic. The disengaging device 7 exhibits at least two identically constructed swingout arms 10 each of which is articulated in a swivelable manner through an axle 11 on a traveling carriage 12 in essentially a horizontal plane.

Each of these traveling carriages 12 is provided with two runners 13 freely pivoting around essentially horizontal axles. By means of these, the carriage braces itself on the guide rail 9 of the stationary frame 1 parallel to its plane.

The other end of the swing out arms 10 engage the bottom end of the movable wing 3 through an axle 14 in a swiveling manner.

The two traveling carriages 12 of the disengaging device 7 are preferably connected firmly by means of a coupling rod 15, illustrated in FIG. 8, so that the bearing axles 11 of the two swingout arms 10 are constantly held at a fixed spacing from one another. Since the axles 14 of the swing out arms engage the edge of the wing 3 with a constant spacing from one another, the wing 3, the traveling carriages 12 with their coupling rod 15, and the two swing out arms 10 together form a guide parallelogram. With the aid of this guide parallelogram the wing 3 can be shifted transverse to its own plane and also transverse to the plane of the stationary frame 1 between a closed position (shown in FIG. 7) and the parallel stop position shown in FIG. 8.

When the disengaging device is in the configuration corresponding to FIG. 7, it is possible to move the wing from the closed position corresponding to FIG 1 and 2 into the tilt open position seen in FIGS. 3 and 4. When the disengaging device is configured in the parallel stop position shown in FIG. 8, the wing can be shifted horizontally into the open position evident from FIGS. 5 & 6.

To insure that the wing 3 remains in the parallel stop position with reference to the stationary frame during the horizontal shifting action, it is necessary to block the parallel stop position. This means blocking at least the swing out arms 10 of the lower disengaging device 7 against the stationary frame 1 or against the traveling carriage 12 on its rail 9 by means of a special blocking device 16. However, it is necessary that the blocking device 16 be released and the blocking of the parallel stop position of the swing out arms 10 be ended as soon as the wing 3 reaches the end of its closing slide motion. This is so that it can end up in the closed position of FIG. 7 against the stationary frame from the parallel stop position of FIG. 8

In the simplest configuration, such a blocking device 16 is only provided between the lower swing out arm 10 on the closing side of the wing and the traveling carriage 12 which supports it, although it would be perfectly possible to provide both swingout arms and both traveling carriages 12 with such a blocking device. Because the two swingout arms 10 are provided with an interaction, being configured in the manner of a guide parallelogram, it is fully sufficient to provide the releasable blocking device 16 only in the region of the swingout arm 10 and the traveling carriage 12 on the closing side of the wing. As seen clearly in FIG. 7 and 8, an additional arm 17 is provided having a pivotal constant connection by means of a joint 18 at one end to at least the lower swingout arm 10 on the closing side of the disengaging device 7. The additional arm engages a guide slot 20 by means of a pinion 19 on its other end in which it is swivelable and movable and which is located in a bearing block 21. This block sits at the space site front of the wing 3 and further provides support for the bearing axle 14 of the swingout arm 10.

The guide slot 20 extends essentially in the same direction as the plane of the wing 3. It is provided at the end corresponding to the parallel stop position of the wing with an uptake notch 22 for the pinion 19 of the additional arms 17. This uptake notch 22 proceeds at an angle relative to the guide slot 20 and its angle of inclination has at least approximately a covering position The notch is a segment of a curve whose radial center corresponds to the joint 18 between the swingout arm and the additional arm 17 when these are in a position which corresponds to the parallel stop position as shown in FIG. 8.

Thus the uptake notch 22 joins the guide slot in such a way that its end on the wing 3 faces away from the stationary frame.

Normally, the pinion 19 of the additional arm 17 slides longitudinally in the guide slot 20, that is when the swingout arm 10 is swiveled against the wing 3 around the swivel axle 14 which is on the bearing block 21 between the initial position as seen in FIG. 7 and the parallel stop position as seen in FIG. 8. However, in the parallel stop position, the pinion can be swiveled around the joint 18 either inward or outward in the opposite direction.

When the pinion on the additional arm 17 engages in the uptake notch 22, the additional arm 17 acts (along with the swingout arm 10 as a blocking device 16 which blocks the swingout arm 10) relative to the wing 3 in the angular position which corresponds to the parallel stop position. In this manner, the wing 3 is held in a predetermined parallel position a certain distance from the stationary frame 1, in which position it can be shifted in a horizontal direction by means of the traveling carriages 12 parallel to the plane of the stationary frame 1.

The blocking device 16 which is formed by the interaction of the additional arm 17 and the uptake notch 22 along with the swingout arm 10 is controlled by means of a control arm 23. This control arm is mounted in a swiveling manner on the traveling carriage 12 at support point 23' as indicated on FIG. 9 and is limited approximately to a horizontal plane. It is advantageous that the bearing axle of this control arm be in alignment with the axle 11 around which the swingout arm 10 is connected in a swiveling manner, to the traveling carriage 12.

The control arm 23 is configured as a two armed lever whose first lever arm 24 projects beyond the traveling carriage 12 in the direction that the wing is slid closed, the first lever arm carrying at its free end a pinion which acts as a locking link 25. The second lever arm 26 of the control arm 23 proceeds at an obtuse angle to the first lever arm 24 and its free end engages a connection latching 28 via a joint 27. This connection latching 28 is, in turn, in constant connection with the additional arm 17 by a joint 29 which is located between the additional arm's joint 18 with the swingout arm 10, on the one hand, and the pinion on the additional arm 19, on the other hand. In the closed position of the wing as shown in FIG. 7, the joint 27 lies in the same plane as the joint 14 of the swingout arm 10, this plane being parallel to the stationary frame 1.

The swingout arm 10, the lever arm 26 of the control arm 23, the connection latching 28, and the additional arm 17 together form a link quadrilateral. Through the mediation of this link quadrilateral, the pinion 19 on the additional arm 17 is subject to a limited angular adjustment when the wing is in the parallel stop position as in FIG. 8 when the pinion is in the region of the uptake notch 22. This adjustment depends on a swivel motion caused by the locking link 25 of the control arm 23 between the blocking position shown in dashed lines and in the release position drawn in full lines.

The actuation of this control arm is achieved when the pinion which works as a locking link 25 at the free end of the lever arm 24 interacts with a fixedly mounted thrust bearing 30 on the stationary frame 1. This thrust bearing has a shape of an arcuate or curved claw 31 and the inlet/outlet opening 32 lies closer to the plane of the stationary frame than does the closed end section 33.

When the wing 3 is shifted horizontally in a closing direction (in FIGS. 7 and 8 this would be from right to left) then the locking link also runs from right to the left into the outlet/inlet opening 32 of the claw 31 and is thereby diverted away from the plane of the stationary frame 1 until it stops in the region of the closed end section 33. In this manner, the control arm 23 is swiveled against the traveling carriage 12 around the axle 11. That is, the first lever arm 24 is swiveled away from the stationary frame 1 but the second lever arm 26 is swiveled toward the stationary frame. The second lever arm 26 therefore acts with a pulling motion on the connection latch 28 which motion is transmitted to the additional arm 17. Thus the pinion 19 located on the additional arm is pulled back from the uptake notch 22 into the area of the guide slot 20 so that the blocking device 16 is released. At this point, the swingout arm 10 can be swiveled from the parallel stop position of FIG. 8 toward the stationary frame 1 until the wing takes up the closed position of FIG. 7.

As the swingout arm 10 swings inward, the pinion 19 of the additional arm 17 is shifted. This is accomplished by the action of the joint or link quadrilateral which is formed by the swingout arm 10, the lever arm 16, the connection latching 28, and the additional arm 17. The pinion is shifted in a longitudinal direction along the guide slot 20 in such a manner that, by means of the control arm 23, the locking link 25 is held on the stationary frame by the claw 31 in a positive form locking engagement, immovably fixing it as to position.

On the other hand, when the wing 3 is brought from the closing position of FIG. 7 into the parallel stop position of FIG. 8 relative to the stationary frame by means of the swingout arms 10, the joint or link quadrilateral releases the control arm 23 and its locking link 25 for possible limited swivel motion around the axle 11. It is only because of this that it is possible to perform a horizontal shifting the wing 3 relative to the stationary frame from left to right. This is because the locking link 25 is able to leave the arcuate curved claw 31, moving from the closed end section 33 toward the outlet/inlet end 32. This movement of the locking link 25 within the arcuate curved claw is however linked necessarily to the swinging end of the pinion 19 on the additional arm 17 into the uptake notch 22. Because of this fact, the blocking device 16 becomes automatically effective.

It has proven preferable to act upon the control arm 23 and/or the connecting joint 27 between its lever arm 26 and the connection, lashing 28 using an initial stressing force; particularly a leg spring 26' as shown schematically in FIG. 8. This spring acts in such a manner that by it, the additional arm 17 is constantly biased toward engaging its pinion 19 in the uptake notch 22. Thus even when the locking link 25 is located outside the operating range of the stationary thrust bearing 30 or the claw 32 the blocking device 16 is automatically held and fixed in its engagement position.

As shown in FIGS. 7 and 8 both swingout arms 10 of the disengaging device 7 can be provided each with an additional arm 17. This second additional arm 17 acts through its respective pinion 19 together with respective guide slot 20 and a notch uptake 22 on the same wing 3. In such a case it is preferable to couple the wing-side ends of the two additional arms 17 with one another in a synchronous manner; for example, by means of a thrust bearing or thrust rod 34 which engages between the two pinions 19.

Not only can synchronous movements of the two swingout arms 10 of the disengaging device 7 be forceably controlled in this manner but also both additional arms 17 act as blocking devices 16 together with the wing 3 and both the arms can be actuated from a common control arm 23.

Figure 9:
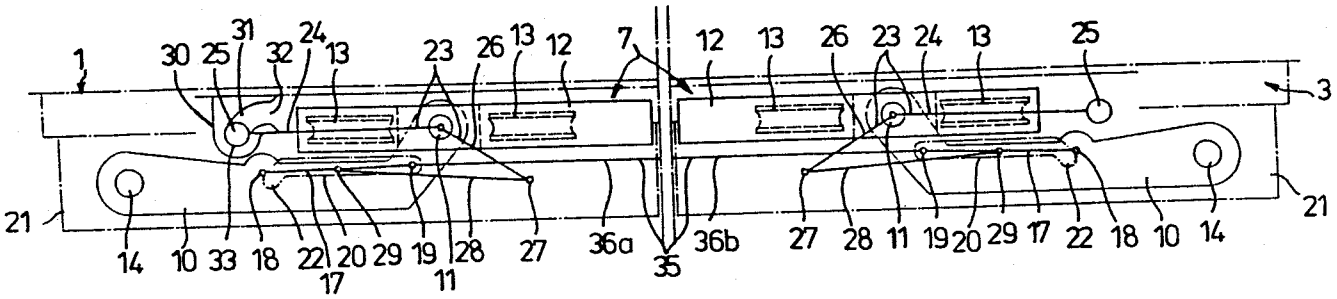
Figure 10:
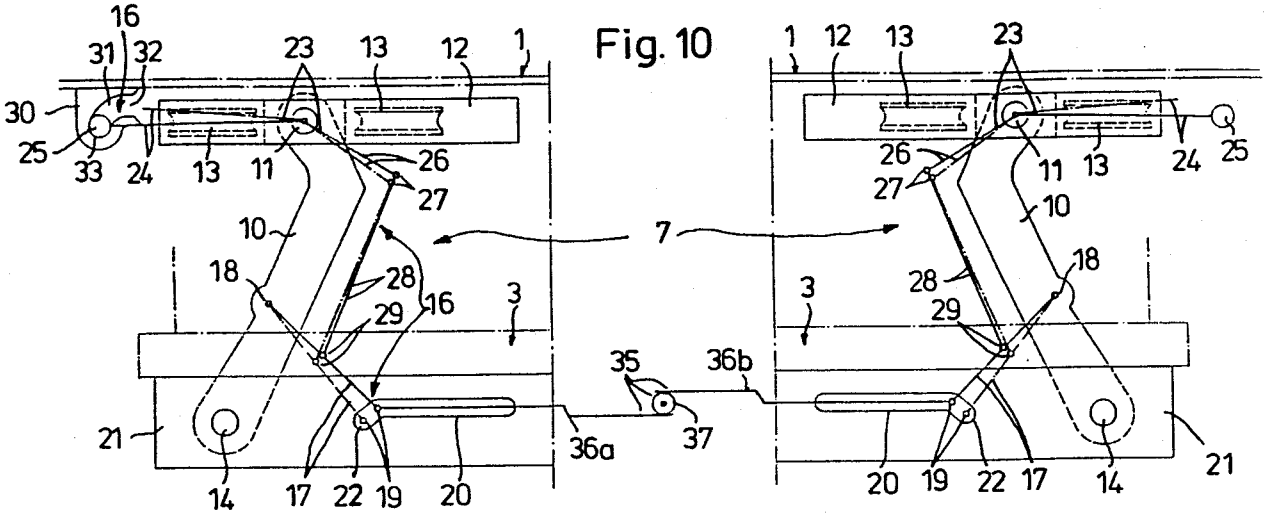

The disengaging device shown in FIGS. 9 and 10 differs from that shown in FIGS. 7 and 8 essentially by the fact that it consists of two configurations which are mirror images of each other comprising the traveling carriages 12 with their swingout arms 10, their additional arms 17 and the associated bearing blocks 21 on the wings 3. Each of these traveling carriages is also equipped with a control arm 23 and a connection latching 28 which couples it with the additional arm 17.

The ends of both of these additional arms 17 which are guided by means of pinions 19 in guide slots 20 in a pivotal and movable manner are in this case able to be forceably moved in connection with one another, but in a counter-rotating manner, by means of a differential coupling gear 35. This may consist, for example, of two thrust rods 36*a* and 36*b* which are kept in constant driving connection with one another through a reversing pinion.

The disengaging device 7 presented in FIGS. 9 and 0 has the advantage compared with that of FIGS. 7 and 8 that it can be used in one and the same construction configuration for movable window and door wings which move horizontally to the right or to the left into the open position. A further advantage of this configuration according to FIGS. 9 and 10 is that a trapezoid guide system is formed between the wing 3 and the two traveling carriages. Because of this, the bearing axles of both swing out arms 10 on the wing side of the system exhibit concordant support distances from the two wing corners, respectively.

Clearly minor variations can be made in the form and construction of this invention without departing from the material spirit of it. Therefore, it is not desired to confine the invention to the embodiments laid out here but to encompass all constructions which come within the scope claimed.

I claim:

1. A disengaging device for a window, door or the like, a wing of which is to be pulled out and blocked into a stable position parallel to a stationary frame for the purpose of sliding the wing sideways from a closed to an open position, in which at least one pair of swingout arms is provided each pivotally mounted at one end on a transverse bar of the slidable wing and pivotally connected at the other end to a traveling carriage guided on the stationary frame, the disengaging device having a releasable blocking device activated when the wing is in a stable position parallel to the frame and separated therefrom, the blocking device having a control are associated with the traveling carriage which can be brought into and out of operative connection by means of a locking link with a thrust bearing which is located on the stationary frame when the wing approaches its closed configuration, the control arm being swivelably supported on the traveling carriage and limited to horizontal plane motion, the control arm configured as a two-armed lever, having a first lever arm and a second lever arm, the locking link located at the free end of the first lever arm which extends in the direction of the closing configuration of the wing the device characterized by the fact that, an additional arm is pivotally connected to the swingout arm at an intermediate point, the additional arm engaging by means of a pinion in a guide slot 20 on the wing, the guide slot being provided at one end with a uptake notch for the pinion and located to accept the pinion when the wing is in the parallel disengaged configuration, the device having a further characteristic that the free end of the second lever arm of the control arm is articulated to a connection lashing which engages the additional arm at a point between its pinon and its joint with the swingout arm by a swiveling connection thereby coupling the motion of the control arm with the additional arm.

2. A disengaging device as recited in claim 1, wherein the control arm has a support point on the traveling carriage which is approximately in alignment with the connection between the swing out arm and the traveling carriage.

3. A disengaging device as recited in claim 1, wherein the two lever arms of the control arm are configured at an obtuse angle to one another so that the joint between the second lever arm and the connection lashing lies in the same plane as the connection point of the swingout arm on the wing, the plane being approximately parallel to the stationary frame, when in closed configuration.

4. A disengaging device as recited in claim 1, wherein the thrust bearing which is located on the stationary frame has a shape of an arcuate curved claw having an outlet/inlet opening and a closed end section the outlet-/inlet opening lying nearer to the plane of the stationary frame than its closed end section lies.

5. A disengaging device as recited in claim 1, wherein the control arm is biased toward a blocking configuration by means of a spring or equivalent.

6. A disengaging device as recited in claim 1, wherein the uptake notch is disposed at an angle relative to the guide slot and wherein its angle of inclination has at least approximately a covering position and is provided with a curvature whose center of radius coincides with the joint between the additional arm and the swingout arm when the device is in a configuration where the wing is in its position disengaged from and parallel to the stationary frame.

7. A disengaging device as recited in claim 1 wherein the uptake notch is disposed with its end facing away from the stationary frame.

8. A disengaging device as recited in claim 1, wherein both swingout arms of the pair are provided with additional arms and wherein the ends of the additional arms facing the wing are coupled with each other by a thrust rod or equivalent so that they are synchronously movable.

9. A disengaging device as recited in claim 1, wherein the two swingout arms of the pair along with their respective traveling carriages, their respective additional arms and the respective bearing blocks on the wingside are configured as mirror image arrangements, the additional arms of the two configurations being connected with each other for mutual enforced movement by means of a differential coupling gear through a swivelably movable connection at the ends of the two additional arms nearest the wings.

10. A disengaging device as recited in claim 9, wherein the differential coupling gear consists of two thrust rods kept in constant driving condition with each other by means of a reversing gear.

* * * * *